United States Patent [19]

Jung

[11] Patent Number: 4,982,940

[45] Date of Patent: Jan. 8, 1991

[54] MACHINE FOR LAYING A FABRIC WEB WITH SURFACES FOR DIRECTING THE FABRIC WEB

[75] Inventor: Rolf Jung, Waiblingen, Fed. Rep. of Germany

[73] Assignee: Krauss u. Reichert GmbH + Co. KG, Fed. Rep. of Germany

[21] Appl. No.: 351,752

[22] Filed: May 15, 1989

[30] Foreign Application Priority Data

May 18, 1988 [DE] Fed. Rep. of Germany ..... 3816882

[51] Int. Cl.[5] ..... B65H 29/46

[52] U.S. Cl. ..... 270/30; 270/31

[58] Field of Search ..... 270/30, 31

[56] References Cited

U.S. PATENT DOCUMENTS

| | | | |
|---|---|---|---|
| 2,795,416 | 6/1957 | Bax | 270/31 |
| 3,112,107 | 11/1963 | Theodosiou | 270/31 |
| 3,540,720 | 11/1970 | Merrill | 270/31 |
| 3,778,050 | 12/1973 | Grimm et al. | 270/31 |
| 4,086,835 | 5/1978 | Frederick | 270/30 |
| 4,781,366 | 11/1988 | Tagawa | 270/31 |

FOREIGN PATENT DOCUMENTS 3218484 11/1983 Fed. Rep. of Germany .

*Primary Examiner*—Edward K. Look
*Assistant Examiner*—Therese M. Newholm
*Attorney, Agent, or Firm*—Barry R. Lipsitz

[57] ABSTRACT

In order to so improve a fabric laying machine for the zigzag laying of a fabric web with a means for guiding the fabric web, comprising a means for delivery of the fabric web which is guided at a predetermined height above a pile of laid-out fabric layers and from which the fabric web falls freely during the laying and passes along a bend into the top fabric layer, and further comprising a cutting-off means which is associated with the means for delivery of the fabric web, that exact laying-out of the fabric layers is possible in the region of the edges of the pile of layers, it is suggested that a surface for directing the fabric web which deflects the fabric web falling freely from the means for delivery of the fabric web be movable beneath the means for delivery of the fabric web.

26 Claims, 10 Drawing Sheets

Figure 1:
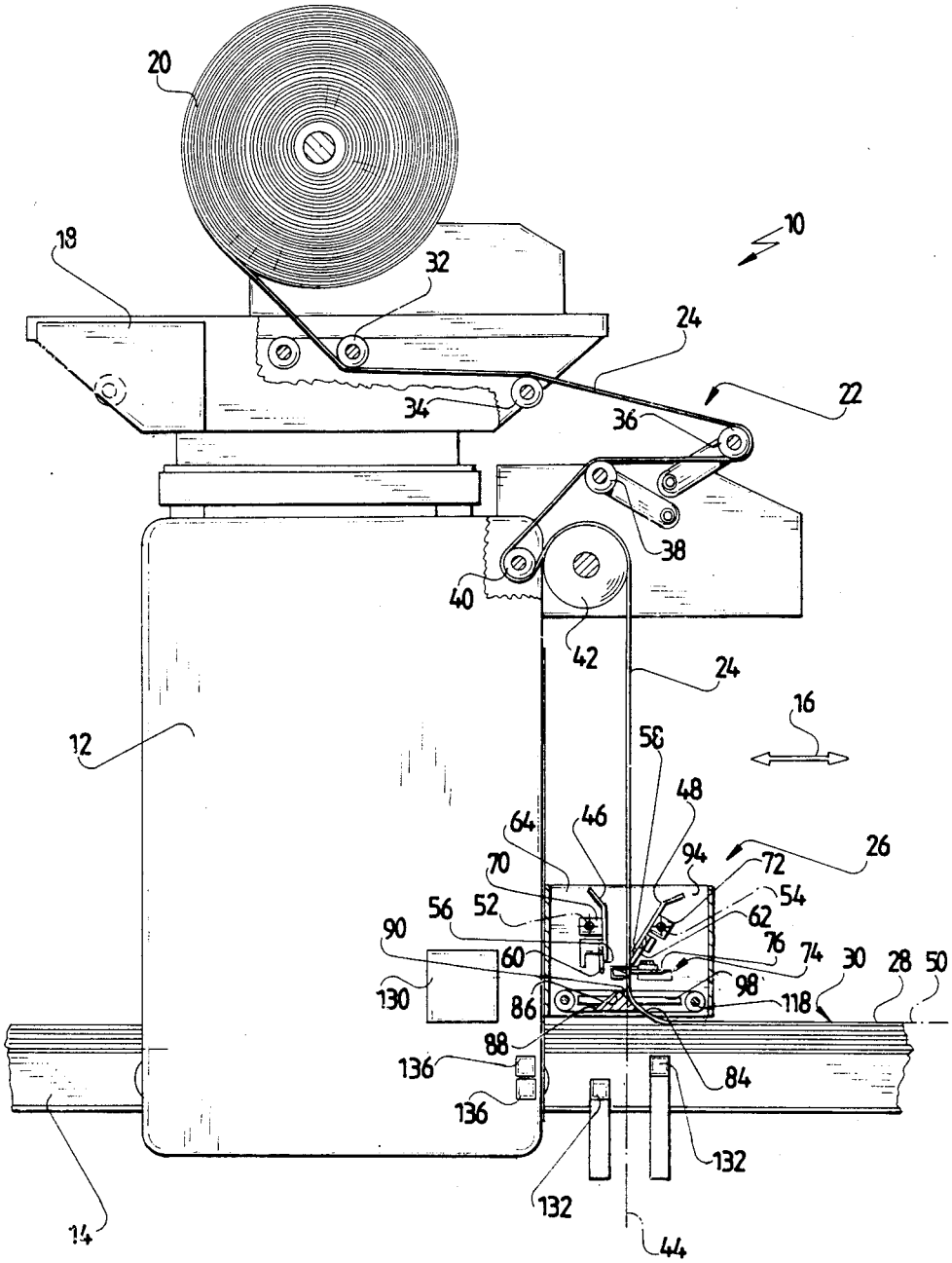

26
16
94
114
98
IV
II/V
86
76
74
82
78
80
54
72
68
48
62
58
84
90
24
58
62
56
60
56
60
92
86
88
46
52
70
66
86
I/VI
III
64
H
A
28
50
30
14
44

MACHINE FOR LAYING A FABRIC WEB WITH SURFACES FOR DIRECTING THE FABRIC WEB

The invention relates to a fabric laying machine for the zigzag laying of a fabric web with a means for guiding the fabric web, comprising a means for delivery of the fabric web which is guided at a predetermined height above a pile of laid-out fabric layers and from which the fabric web falls freely during the laying and passes along a bend into the top fabric layer, and further comprising a cutting-off means which is associated with the means for delivery of the fabric web.

With such laying machines there is constantly the problem that after the laying-out of a fabric layer and the cutting-off of the fabric web, an inherent curvature in the fabric web causes both an end of the laid-out fabric layer and an end of the fabric web which is still in the fabric laying machine to curl up, in particular, in the region of the fabric delivery means, which leads to problems when laying is started again as the fabric web either rolls in or at least forms folds, with the result that in the region of the edges extending transversely to the laying direction, the pile of fabric layers does not exhibit precisely laid-out fabric layers with superimposed cut edges but is laid out with wrinkles at least in this region and is, therefore, only usable to a limited extent for later processing.

The object underlying the invention is, therefore, to so improve a fabric laying machine of the kind described at the beginning that exact laying-out of the fabric layers is possible in the region of the edges of the pile of layers.

This object is accomplished in accordance with the invention in that a surface for directing the fabric web which deflects the fabric web falling freely from the means for delivery of the fabric web is movable beneath the means for delivery of the fabric web.

Hence by virtue of the surface for directing the fabric web, the invention creates the possibility of deflecting a fabric web which hangs with a curved region adjoining the cut edge down from the means for delivery of the fabric web such that the cut edge comes to rest coincidentally with the edge of the pile of layers at which it is to be laid, and/or an end of the top fabric layer which is produced by the cutting-off of the freely falling fabric web and projects upwardly from the pile of fabric layers on account of the inherent curvature is spread out.

In a particularly effective type of design of the surface for directing the fabric web, this surface deflects the freely falling fabric web in the direction opposite to the laying direction. Such a surface for directing the fabric web serves, in particular, to deflect an end of a fabric web which is still in the fabric laying machine.

In particular, as a supplement thereto, a design of the surface for directing the fabric web in which the surface for directing the fabric web smooths out a freely falling end of the fabric layer in the laying direction is expedient.

To this end, the surface for directing the fabric web could be designed in different ways. It is, for example, possible to arrange the surface for directing the fabric web as rotating part which takes the fabric web hanging down onto it along with it by means of its rotation.

It is, however, structurally much simpler for the surface for directing the fabric web to be inclined in the direction opposite to the respective laying direction so that it automatically deflects the freely falling fabric web in the direction opposite to the laying direction.

In order to deflect the entire fabric web as uniformly as possible throughout its entire width, it has proven highly advantageous for the surface for directing the fabric web to extend transversely across a width of the fabric web.

In the embodiments dealt with so far, no details have been given of the manner of movability of the surface for directing the fabric web. It has, for example, proven expedient for the surface for directing the fabric web to be movable in the laying direction and also in the direction opposite thereto relative to the means for delivery of the fabric web.

Here, it is, in particular, expedient for the surface for directing the fabric web to be movable below the means for delivery of the fabric web and between the latter and the pile of layers.

In this case, the surface for directing the fabric web may move on very different geometrical paths in this region.

A solution wherein the surface for directing the fabric web is movable in a plane substantially parallel to the layer plane is, however very simple from a structural point of view.

In the description of the embodiments so far, no further details have been given of the region in which the surface for directing the fabric web is to be movable. It has proven adequate and expedient for the surface for directing the fabric web to be movable beyond the means for delivery of the fabric web.

In particular, in order to make full use of the advantages of employing a surface for directing the fabric web in the zigzag laying in both laying directions, two surfaces for directing the fabric web are provided to deflect the freely falling fabric web in respectively opposed directions. In such an embodiment, in particular, additional provision is made for either the one or the other surface for directing the fabric web to be movable into its effective position beneath the means for delivery of the fabric web so that the one surface for directing the fabric web is in use during the laying in the one direction and the other surface for directing the fabric web is in use during the laying in the other direction.

In principle, the two surfaces for directing the fabric web could be arranged on different machine parts. It is, for example, possible to arrange each surface for directing the fabric web on a bar and for that bar which comprises the appropriate surface for directing the fabric web to be respectively brought into its effective position. A solution wherein the surfaces for directing the fabric web are arranged on one element for directing the fabric web so that this element for directing the fabric web only has to be movably arranged in order to change from the effective position of the one surface for directing the fabric web to the effective position of the other surface for directing the fabric web is, however, structurally much simpler.

If both surfaces for directing the fabric web are arranged on one element for directing the fabric web, these could, for example, be so arranged relative to each other that they form a funnel leading to a funnel opening. For space reasons it is, however, more expedient for the element for directing the fabric web to comprise surfaces for directing the fabric web which form a wedge surface facing the means for delivery of the fabric web with its tip so that the two surfaces for directing the fabric web are arranged in the shape of a roof.

In a further favorable embodiment of the invention, the element for directing the fabric web comprises surfaces for directing the fabric web which deflect with one portion a freely falling end of the fabric web in the direction opposite to a laying direction and smooth out with a further portion a freely falling end of the top fabric layer during the laying in the opposite laying direction.

Since the fabric web advance of the fabric web guide in the laying machines normally used is rigidly coupled with the speed of the laying carriage, a path of displacement of the fabric laying machine itself should not be determined by the limited movability of the element for directing the fabric web. For this reason, it is expedient within the scope of the present invention for the element for directing the fabric web to be movable with each directing surface beyond the means for delivery of the fabric web so that the movability of the element for directing the fabric web has no effect whatever on the paths of displacement of the inventive fabric laying machine but independently thereof the element for directing the fabric web in the inventive solution is movable over a path required for the deflection of the freely falling fabric web.

To enable substantially automatic operation of an inventive fabric laying machine, provision is made for the element for directing the fabric web to be movable by a drive means.

To this end, the element for directing the fabric web should, furthermore, be appropriately guided on the fabric laying machine. The simplest solution from a structural point of view is for the element for directing the fabric web to be slidably held at its opposite ends on longitudinal guides.

In the description of the embodiments so far, the design of the means itself for delivery of the fabric web is not specified in detail. In order to guide the fabric web in as defined a manner as possible and, in particular, in order to hold the fabric web during the cutting, it is expedient for the means for delivery of the fabric web to comprise a device for clamping the fabric web.

In the simplest design of such a device for clamping the fabric web, it comprises two jaws which are movable towards each other.

Since the fabric web usually has to be introduced into this device for clamping the fabric web, which, as a rule, is carried out by a fabric web being advanced along a plane of fall, it is expedient for the jaws to be designed as side portions of an intake funnel into which the freely falling fabric web can be introduced very easily.

The above-described features of individual embodiments relate solely to the structural design of such a fabric laying machine. In order to make full use of the advantages according to the invention, particularly preferred embodiments comprise a control means which is capable of positioning the element for directing the fabric web in very different working positions.

In one embodiment, it is expedient for the control means to position the element for directing the fabric web ahead of a bend in the fabric web during the laying-out. More particularly, the element for directing the fabric web may be positioned so as to support the bend by means of a surface for directing the fabric web during the laying-out.

It is particularly expedient, however, especially for laying the fabric web at the pile of layers, for the control means to position the element for directing the fabric web during laying at the edge of the pile of layers and restarting of the fabric laying machine such that a front cut edge is guided by means of a surface for directing the fabric web to an edge of the pile of layers so that in spite of a bend, the region of the fabric web adjoining the cut edge has no possibility of rolling up or of forming folds.

In a further possibility of use of the inventive element for directing the fabric web, the latter is positioned by a control means such that it supports the fabric web during the cutting so that the fabric web cannot fall down freely after the cutting but rests on the element for directing the fabric web and can then be fully laid out by it on the pile of layers.

Alternatively to the above-described kind of use of the inventive element for directing the fabric web wherein it is positioned ahead of the bend in the fabric web, the advantage according to the invention may also be achieved by the element for directing the fabric web being so positioned by the control means that it follows the bend during the laying-out.

In particular, this arrangement of the element for directing the fabric web enables the control means to move the element for directing the fabric web such that it drives under the fabric web during laying at the edge of the pile of layers, i.e., the fabric web first hangs down freely from the means for delivery of the fabric web, with the fabric web being curved on account of the curvature therein, and the element for directing the fabric web then drives against this downwardly hanging fabric web and is displaced so far that the fabric web is drawn over this element for directing the fabric web and hence bent in the direction of the edge of the pile of layers and laid out so that the fabric web is laid with its cut edge coincidentally at the edge of the pile of layers.

Furthermore, within the scope of the inventive fabric laying machine, a control means which moves the element for directing the fabric web such that it spreads out the cut-off fabric web at the edge of the pile of layers is useful. This also is achievable, in particular, with an element for directing the fabric web which is arranged so as to follow the bend during the laying because after the cutting-off, the element for directing the fabric web only has to be moved further in the laying direction and thereby has the possibility of spreading out fully to the edge of the pile of layers the top fabric layer which projects upwardly on account of its curvature.

Further features and advantages are set forth in the following description and in the drawings of several embodiments.

Figure 2:
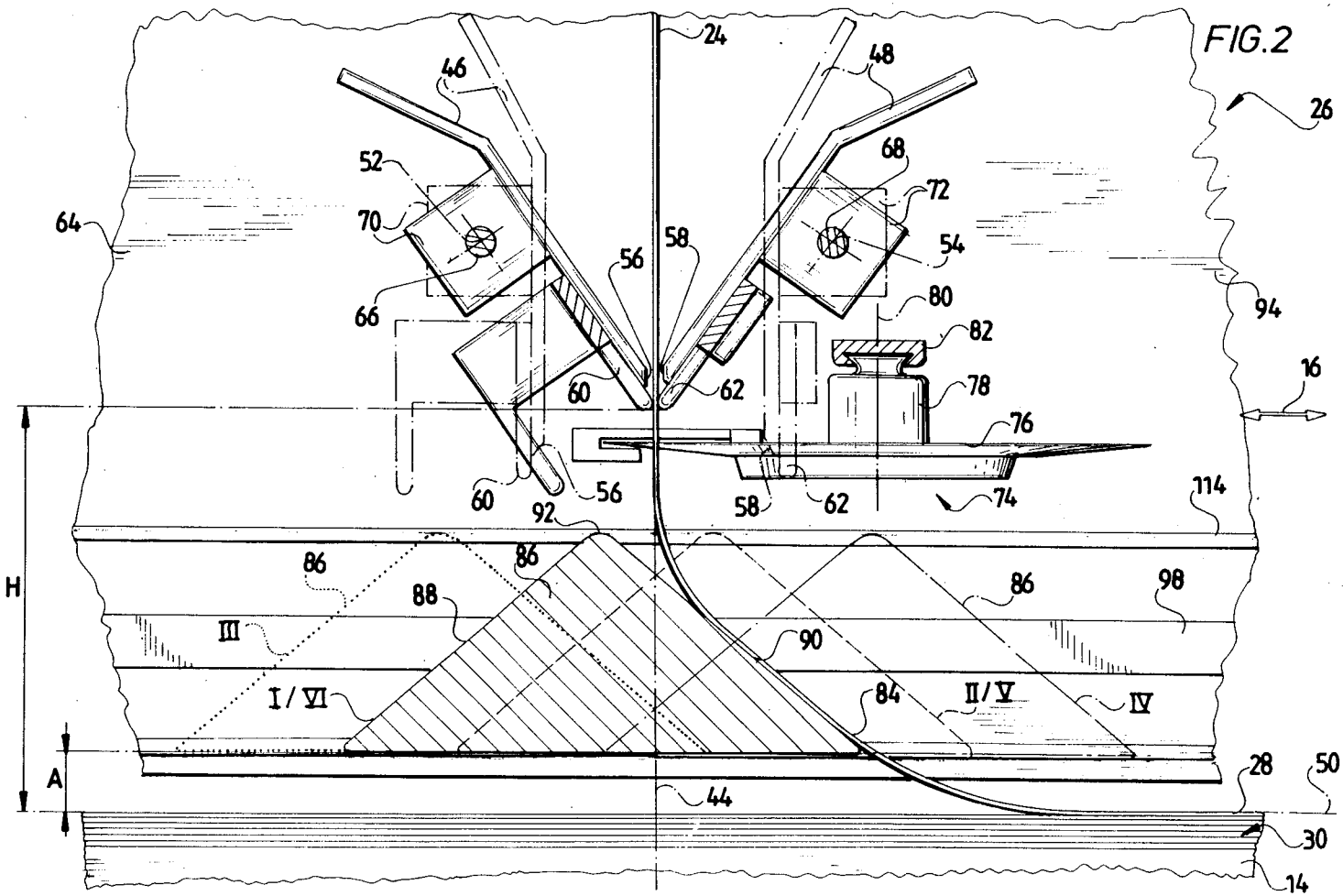
Figure 3:
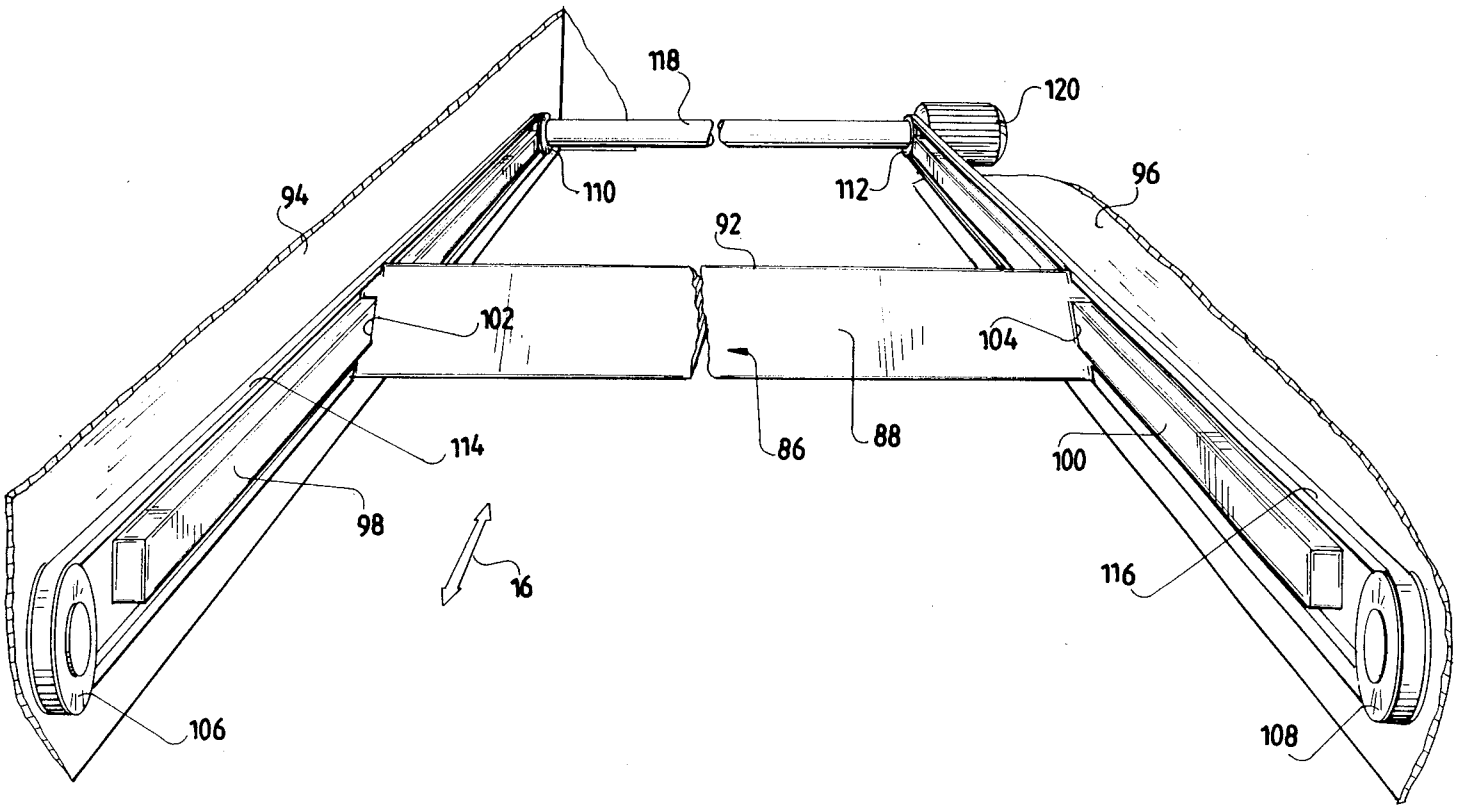

The drawings show:

FIG. 1 a schematic side view of a first embodiment of a fabric laying machine with the laying unit cut open;

FIG. 2 a partially enlarged illustration of the interior of the laying unit in FIG. 1;

FIG. 3 a partial illustration of a guide of an element for directing the fabric web;

FIGS. 4 to 10 a schematic illustration of the function of the first embodiment in different working situations during the laying-out; and FIGS. 11 to 17 a schematic illustration of the function of a second embodiment in working situations similar to those in FIGS. 4 to 10.

A first embodiment of an inventive fabric laying machine, designated in its entirety 10, comprises a laying carriage 12 which is displaceable on a laying table 14 in the laying direction 16.

A fabric web 24 is drawn off a fabric reel 20 rotatably held on an upper laying carriage part 18 by a fabric web guiding means, designated in its entirety 22, and fed in accordance with a speed of the laying carriage 12 in the laying direction 16 to a laying unit, designated in its entirety 26, which lays out the fabric web 24 in a pile 30 of individual fabric layers.

The fabric web guiding means 22 comprises several deflecting rolls 32 to 40 over which the fabric web 24 is guided to a feed roll 42 which is driven in synchronization with the speed of the laying carriage 12.

The laying unit 26 is held for vertical displacement on the laying carriage 12 and is continuously guided at a constant distance from the top fabric layer 28 of the pile of layers 30.

The laying unit 26 comprises two swivel plates 46 and 48 which are arranged symmetrically with a plane of fall 44 defined by the fabric web 24 falling down from the feed roll 42 and which extend transversely across the entire fabric web 24. The swivel plates 46 and 48 can swivel about axes 52 and 54 which extend parallel to the plane of fall 44 and parallel to a layer plane 50 defined by the top fabric layer 28 and which are arranged approximately at the center of the swivel plates 46 and 48 from an open position oriented approximately parallel to the plane of fall —indicated in dot-and-dash lines in FIG. 2 —to a closed position —indicated in continuous lines in FIG. 2. In the closed position, bottom edges 56 and 58 of the swivel plates 46 and 48 which face the layer plane 50 rest against the fabric web 24 extending in the plane of fall 44 and so the swivel plates 46 and 48 form an upwardly open funnel.

On these bottom edges 56 and 58, the swivel plates 46 and 48 are preferably provided with clamping jaws 60 and 62 by means of which the fabric web 24 can be clamped in the closed position of the swivel plates 46 and 48, in particular, for cutting of the fabric web 24 below the clamping jaws 60 and 62, on the side facing the layer plane 50.

The swivel plates 46 and 48 are preferably mounted by means of stud bolts 66 and 68 which are arranged on a housing 64 of the laying unit coaxially with the axes 52 and 54 and engage bearing lugs 70 and 72 held on the respective swivel plates 46 and 48.

A cutting unit designated in its entirety 74 is provided for cutting off the fabric web 24 below the clamping jaws 60 and 62 in their closed Position. The cutting unit comprises a knife wheel 76 oriented parallel to the layer plane 50 and a knife drive 78. This knife wheel 76 is rotatable about an axis 80 oriented parallel to the plane of fall 44 and vertically to the layer plane 50 and touches the fabric web 24 lying in the plane of fall 44 with its outer sharpened circumferential region substantially immediately beneath the closed clamping jaws 60 and 62.

The entire cutting unit 74 is displaceable along a rail 82 transversely across the entire width of the fabric web 24 and also beyond it so that the cutting unit 74 can be brought into a position of rest at the side outside of the swivel plates 46 and 48.

In addition to clamping the fabric web 24 by means of the clamping jaws 60 and 62, the two swivel plates 46 and 48 act as means for delivery of the fabric web during laying of the fabric web 24. The fabric web 24 is held in the plane of fall 44 from the feed roll 42 down to the height of the clamping jaws 60 and 62 by the swivel plates 46 and 48. This is achieved by that swivel plate 46 or 48 which is at the front in the laying direction 16 being swivelled into its open position during the laying-out so that the fabric web 24 passing from the plane of fall 44 into the layer plane 50 in the form of a bend 84 extending in the direction opposite to the respective laying direction 16 rests against the clamping jaw 60 or 62 of that swivel plate 46 or 48 which is at the rear in the laying direction. This means that during laying to the left, the left swivel plate 46 in FIG. 2 stands in its open position while the right swivel plate 48 stands in its closed position so that the fabric web 24 rests against the clamping jaw 62 and after this clamping jaw 62 extends in the form of a bend 84 extending to the right away from the plane of fall 44 to the layer plane 50.

As stated previously, the laying unit 26 is guided on the laying carriage 12 such that the clamping jaws 60 and 62 in their closed position always stand at a constant height H above the layer plane 50.

An element 86 for directing the fabric web is arranged in an inventive manner between the clamping jaws 60 and 62 and the layer plane 50 and extends both parallel to the plane of fall 44 and at a constant distance A parallel to the layer plane 50 transversely across the entire width of the fabric web 24 and also the width of the swivel plates 46 and 48 in this direction. This element 86 for directing the fabric web comprises two surfaces 88 and 90 for directing the fabric web which are aligned in wedge-shaped configuration with each other and are each oriented at the same angle of inclination to the layer plane 50. A tip 92 of the wedge faces the clamping jaws 60 and 62 so that both surfaces 88 and 90 for directing the fabric web form inclined planes on which the fabric web 24 can slide down in the direction of the layer plane 50 under the influence of gravity.

In the simplest case, the element 86 for directing the fabric web is comprised of a wedge-shaped bar.

This element 86 for directing the fabric web is arranged for displacement in the laying direction 16 parallel to the layer plane 50 so that it is displaceable back and forth from an extreme right position located on the right of the plane of fall 44 in FIG. 2 —indicated in dot-and-dash lines —to an extreme left position located on the left of the plane of fall 44 —indicated by dotted lines in FIG. 2. For this purpose, as illustrated in FIG. 3, there is held at each of the side walls 94 and 96 of the housing 64 of the laying unit 26 which extend parallel to the laying direction 16 a guide ledge 98 and 100, respectively. The guide ledges 98 and 100 likewise extend parallel to the layer plane 50. These guide ledges 98 and 100 pass through grooves 102 and 104 in the element 86 for directing the fabric web which are arranged at the ends of the element 86 for directing the fabric web and are open towards the sides. The element 86 for directing the fabric web is guided on the guide ledges 98 and 100 by means of these grooves 102 and 104.

To enable displacement of this element 86 for directing the fabric web in a machine-driven manner along the guide ledges 98 and 100, deflecting rolls 106, 108 and 110, 112 are provided in the region of the two ends of the guide ledges 98 and 100. An endless strand of a tension member 114 and 116, respectively, looped around the respective guide ledge 98 and 100, respectively, extends around each pair of these deflecting rolls 106, 110 and 108, 112, respectively, parallel to the side walls 94 and 96, respectively. In the simplest case, this tension member 114 and 116, respectively, is a chain.

In order to simultaneously drive the two tension members 114 and 116, the deflecting rolls 110 and 112 are connected to each other by a shaft 118 which, in turn, is driven by a motor 120.

Figure 4:
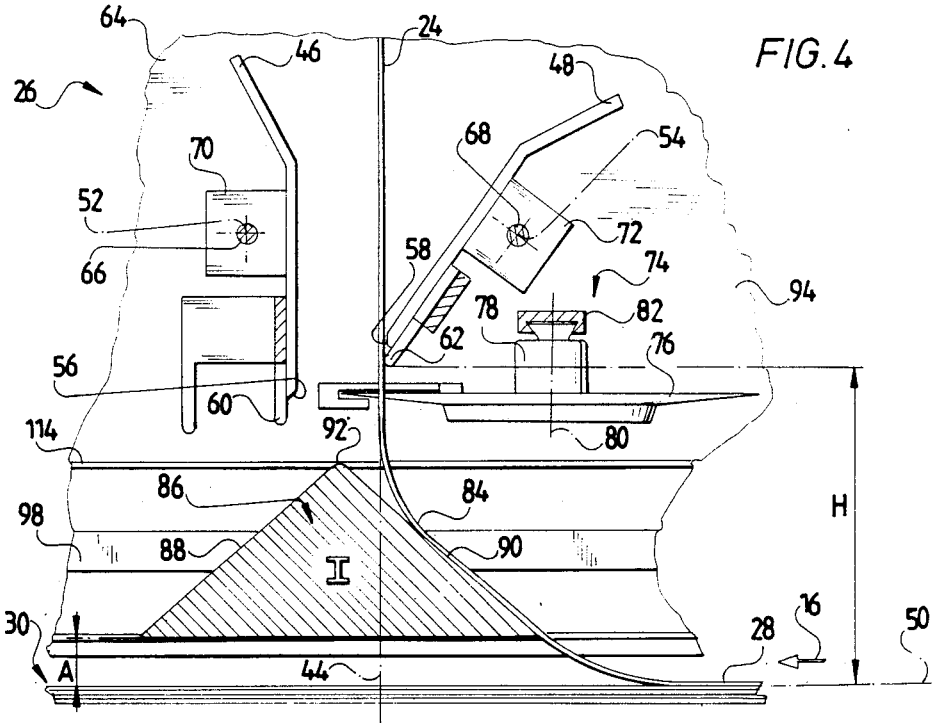

Laying out of the fabric web 24 to form the pile of layers 30 is shown schematically in FIGS. 4 to 10 and is carried out as follows:

In the state illustrated in FIG. 4, the fabric web 24 is laid out by displacement of the fabric laying machine 10 to the left in the direction of arrow 16 by, as mentioned with reference to FIG. 2, the swivel plate 48 standing in its closed position while the swivel plate 46 assumes its open position so that the fabric web 24 moving downwardly from the feed roll 42 in the plane of fall 44 rests against the clamping jaw 62.

From the clamping jaw 62, the fabric web 24 then runs along the bend 84 into the layer plane 50. During this laying-out operation, the element 86 for directing the fabric web stands in its left laying-out position designated I in which the tip 92 stands at the left of the plane of fall 44 and extends parallel thereto, with the bend 84 preferably resting against the central and lower region of the surface 90 for directing the fabric web.

This laying-out to the left with the support of the element 86 for directing the fabric web has the advantage that the range and the position of the bend are substantially defined and-so the fabric web 24 can be laid out into the top fabric layer 28 at uniform speed and there is no occurrence of inaccuracies which without the element 86 for directing the fabric web might result from a change in the arc length of the bend 84.

Figure 5:
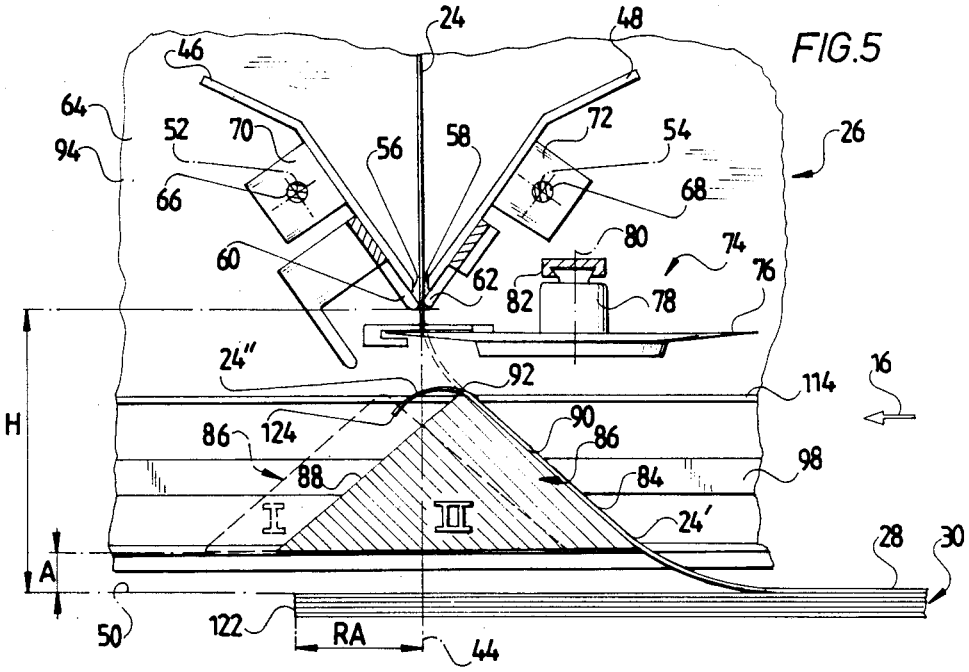

This laying-out to the left is stopped, as illustrated in FIG. 5, a short distance before a left edge 122 of the pile of layers 30, the distance RA between the plane of fall 44 and the left edge 122 being so dimensioned that after the fabric web 24 has been cut off by the cutting unit 74, a cut edge 124 of the cut-off fabric web piece 24' coincides with the left edge 122 when the laying-out is completed.

However, when the fabric web 24 is cut off, in order to prevent the cut-off fabric web piece 24' from sliding down the surface 90 for directing the fabric web and from not being fully laid out owing to the formation of folds therein, with the result that the cut edge 124 does not coincide with the left edge 122 in the laying direction 16, the element for directing the fabric web is displaced from its left laying-out position I, illustrated in dashed lines in FIG. 5, to its left cutting position II in which the tip 92 lies on the right of the plane of fall 44. In this way, the cut-off fabric web piece 24' is made to fall with its region 24'' adjoining the cut edge 124 over the tip 92 to the left and to stand partially above the surface 88 for directing the fabric web. Hence the fabric web piece 24' is prevented from sliding down the surface 90 for directing the fabric web and from thereby forming folds.

Figure 6:
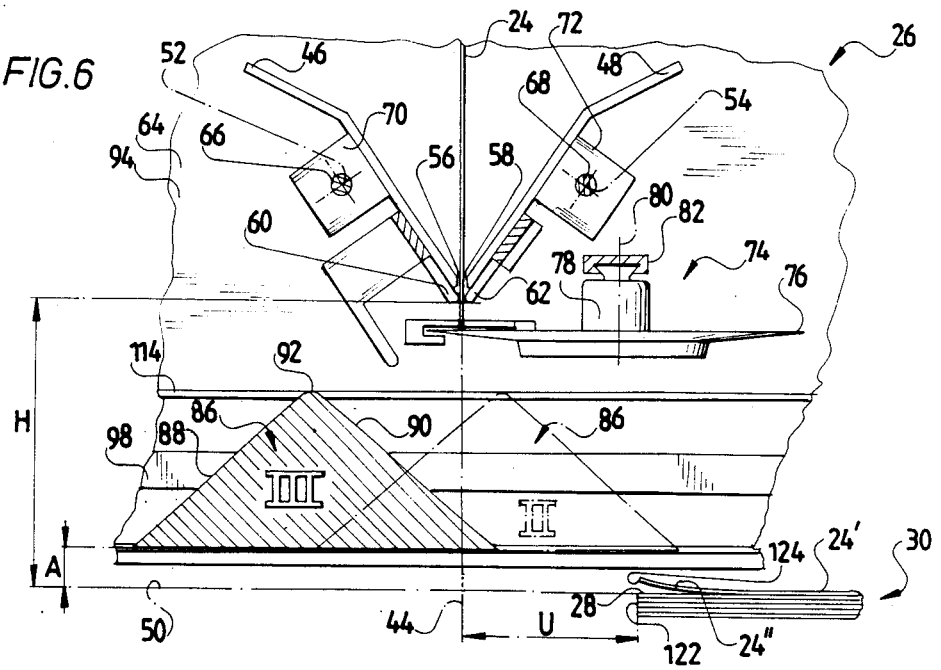
Figure 7:
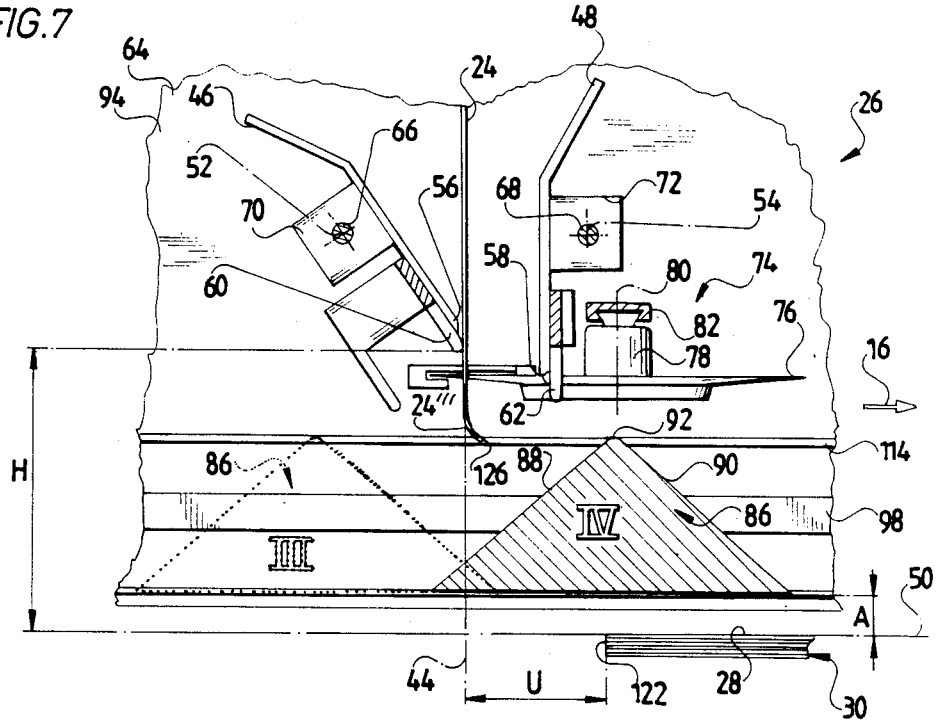
Figure 8:
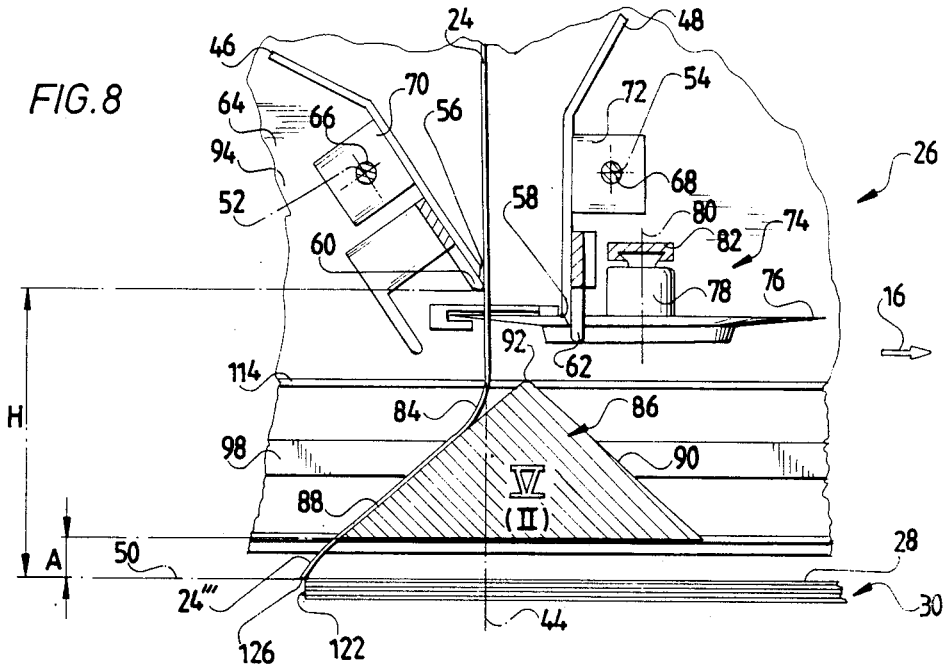

After the cutting, the laying machine 10 is driven to the left beyond the left edge 122 of the pile of layers 30, as illustrated in FIG. 6, but without the fabric web 24 being further advanced by the feed roll 42 and with the fabric web 24 being further clamped by the two swivel plates 46 and 48 in their closed position. Simultaneously, the element 86 for directing the fabric web is displaced from the left cutting position II indicated in dot-and-dash lines in FIG. 6 to the extreme left position III, and the cut-off fabric web piece 24' is completely laid out on the pile of layers 30 so that its cut edge 124 comes to rest level with the left edge 122 of the pile of layers 30. In the stopping position of the laying carriage 12 shown in FIG. 6, the plane of fall 44 lies on the left of the left edge 122 of the pile of layers 30 at a distance U therefrom. This distance U corresponds approximately to one length of the bend 84 during laying. This is necessary because an advance of the fabric web 24 by the feed roll 42 is always only possible in combination with a displacement motion of the laying carriage 12. Starting from this position, for laying out the fabric web 24 by displacement of the laying carriage 12 to the right, illustrated in FIG. 7, the swivel plate 48 is first moved into its open position. Simultaneously, the element 86 for directing the fabric web is moved from its extreme left position III, indicated by dotted lines in FIG. 7, into its extreme right position IV in which the plane of fall 44 intersects the surface 88 for directing the fabric web in a lower region thereof.

When the laying carriage 12 begins to move, the fabric web 24 also starts to advance. The fabric web 24 now hangs down along the plane of fall 44 but on account of the inherent curvature of the fabric web 24 at its front end 24''', oriented, for example, to the right, projects from the plane of fall 44 so that a front cut edge 126 of this fabric web piece 24''' lies on the right of the plane of fall 44.

During the initial laying-out of the fabric web 24 to the right, the element 86 for directing the fabric web is continually displaced from its extreme right position IV to its right laying-out position V, with this right laying-out position V preferably being reached when the fabric web piece 24''' arrives with its front cut edge 126 at the left edge 122 of the pile of layers 30, thereby forming the bend 84, but this time to the left. By means of this motion of the element for directing the fabric web from the extreme right position IV to the right laying-out position V, the front fabric web piece 24''' is gradually bent to the left so that in spite of the bend to the right in the region of the cut edge 126 owing to the natural curvature of the fabric web, the fabric web piece 24' can be laid level with the left edge 122 of the pile of layers 30 since even the rightwardly curved front piece 24''' can be reversed to the left by the element 86 for directing the fabric web being moved towards it in the direction of the plane of fall 44, without this front piece 24''' rolling in or forming folds.

Therefore, once the fabric web 24 has been laid with its cut edge 126 in precise alignment at the left edge 122, problem-free laying-out to the right can be carried out from there.

Figure 9:
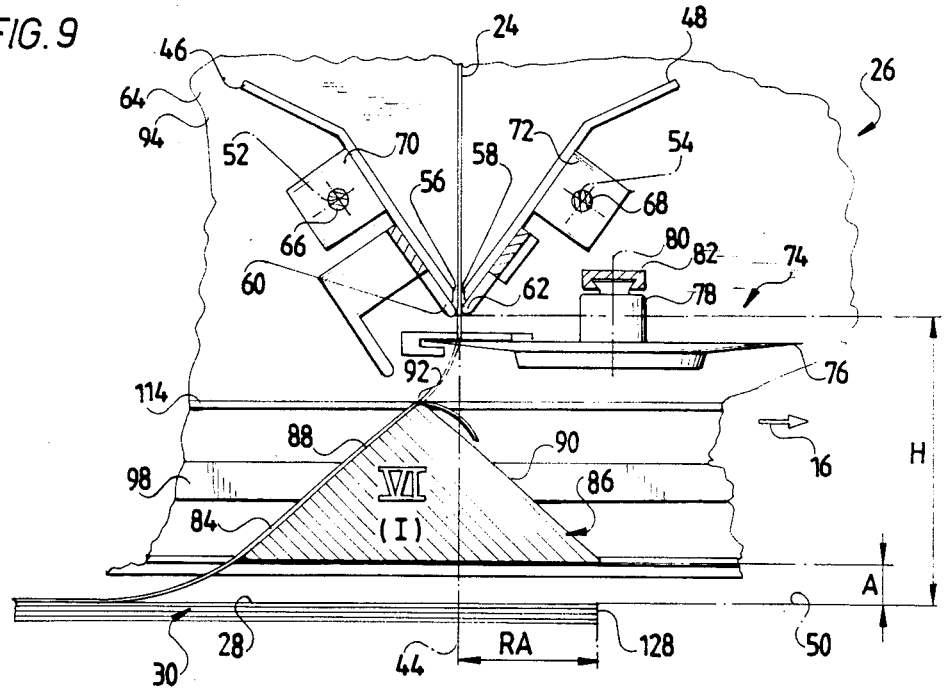
Figure 10:
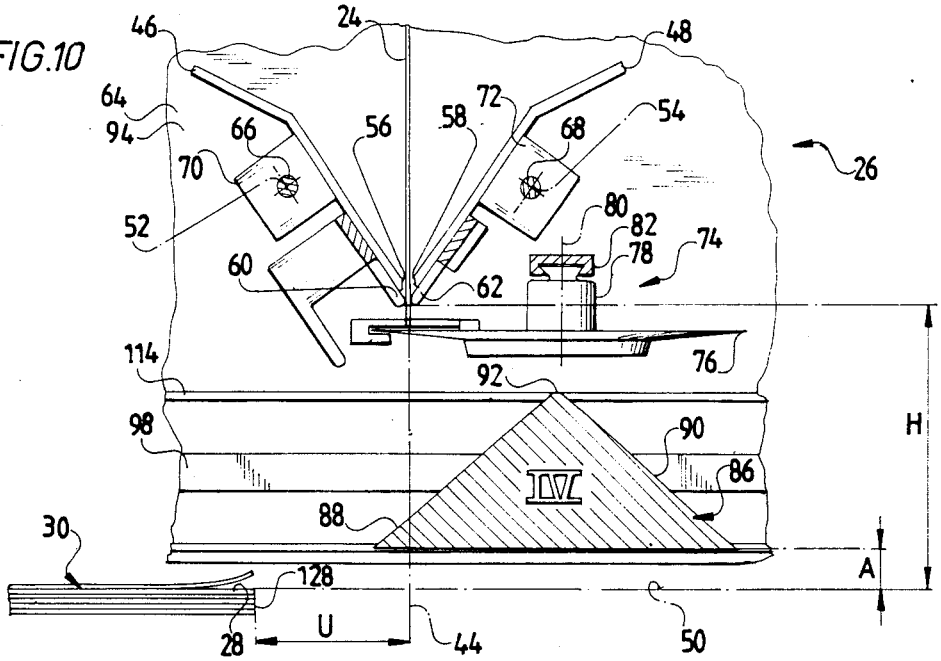

This laying-out to the right is carried out until —as illustrated in FIG. 9 —the plane of fall 44 stands at a distance RA from a right edge 128 of the pile of layers 30. For the cutting-off, the element 86 for directing the fabric web is displaced from the right laying-out position V to its right cutting position VI in which the tip 92 stands on the left of the plane of fall 44. Hence, as illustrated in FIG. 5, the fabric web 24 can be cut off and the remainder laid out by displacement of the laying carriage 12 beyond the right edge 128 —as illustrated in FIG. 10 —with the element for directing the fabric web being simultaneously moved into its extreme right position IV. In the same manner as shown in FIG. 6, there is an overrun U which corresponds approximately to an arc length of the bend 84.

In order to design in as simple a manner as possible a control means 130 of the laying carriage 12 for displacement to the individual positions, which may be detected, for example, by feelers 136 on the laying carriage 12 and stops 132 on the laying table 14, provision is made in an advantageous embodiment for the left laying-out position I of the element 86 for directing the fabric web to be identical with the right cutting position VI, and for the left cutting position II to be identical with the right laying-out position V so that together with the extreme left position III and the extreme right position IV, the element 86 for directing the fabric web can be driven by the motor 120, controlled by the control means 130, to four different positions.

A second embodiment of the inventive fabric laying machine is of exactly the same design as the first embodiment and so the same reference numerals are used for the same parts and reference is made to the explanation of the first embodiment for a description of these, with the sole difference that the element 86' for directing the fabric web does not have surfaces 88 and 90 for directing the fabric web which are arranged in wedge-shaped relation to each other but instead is of oval-like cross-section and has at its side edges extending parallel to the plane of fall 44 and to the layer plane 50 curved surfaces 88' and 90' with a lower and an upper portion. A long cross-sectional axis of the element 86' for directing the fabric web is oriented approximately parallel to the layer plane 50.

As illustrated in FIGS. 11 to 17, in principle, the same advantages in laying out the fabric web 24 are achievable with such an element 86' for directing the fabric web. With respect to the individual working positions, FIGS. 11 to 17 correspond to FIGS. 4 to 10.

Figure 11:
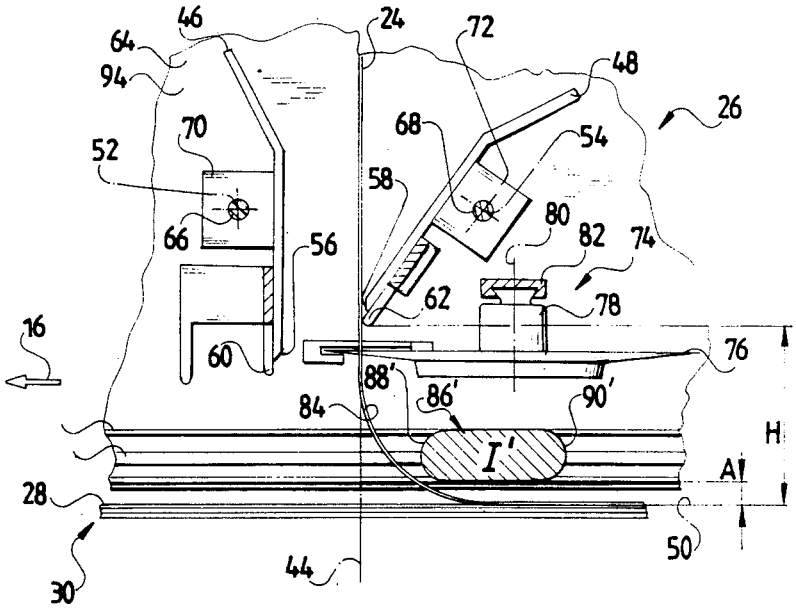

In the laying-out to the left, as illustrated in FIG. 11, the element 86' for directing the fabric web, in contrast with the element 86 for directing the fabric web, is not on the left of the bend 84 but instead follows the bend on the right. Accordingly, the element 86' for directing the fabric web has no function whatever during laying-out to the left.

Figure 12:
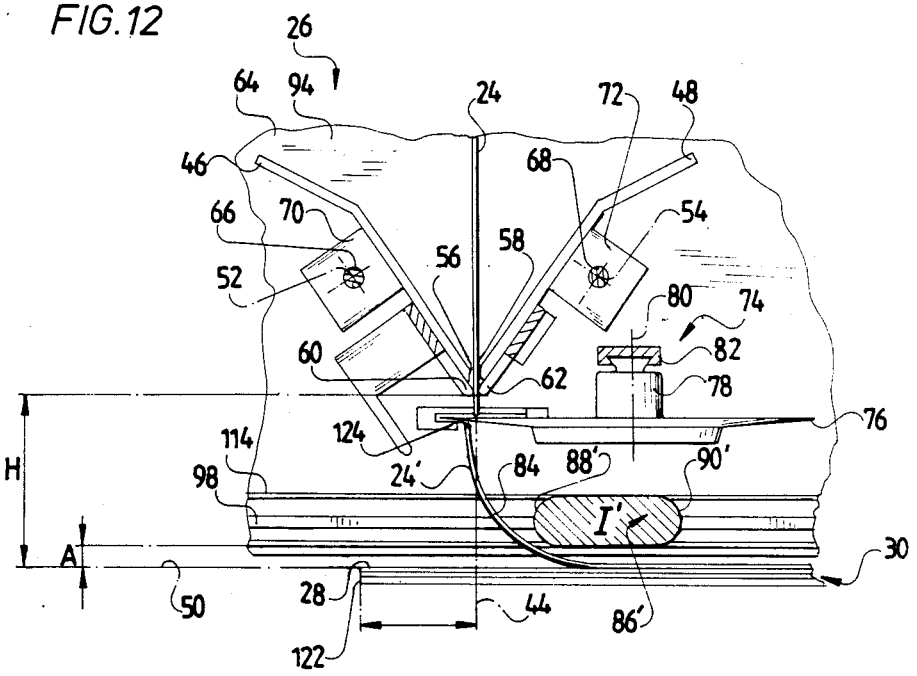

In the cutting-off of the fabric web 24, as illustrated in FIG. 12, the element for directing the fabric web similarly has no function as it is not capable of supporting the fabric web piece 24' after the cutting-off.

Figure 13:
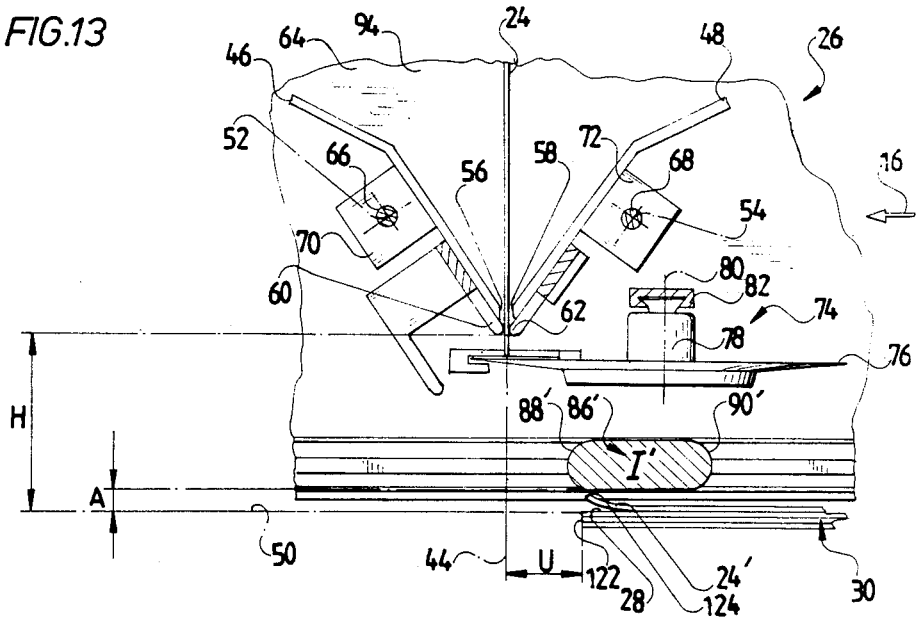

As is apparent from FIG. 13, the fabric web piece 24' falls with its cut edge 124 freely to the left so that when the fabric web 24 has sufficient inherent stiffness, the fabric web piece 24' similarly comes to rest coincidentally with the left edge 122 of the pile of layers 30. As is evident from FIG. 13, the second embodiment with the element 86' for directing the fabric web does, however, offer the possibility during displacement of the laying carriage 12 into the overrun position, without the element 86' for directing the fabric web having to be moved, of spreading out the fabric web piece 24' which has fallen freely, in particular when the fabric web piece 24' projects upwardly on account of the inherent curvature of the fabric web, on the pile of layers 30 by means of the lower portion of the surface 88' for directing the fabric web. This is possible because the element 86' for directing the fabric web stands on the right of the bend 84 during the cutting and so spreading-out can take place automatically by means of the further displacement to the left. To this end, it is expedient for the element 86' for directing the fabric web to extend at as short a distance as possible above the top fabric layer 28.

Figure 14:
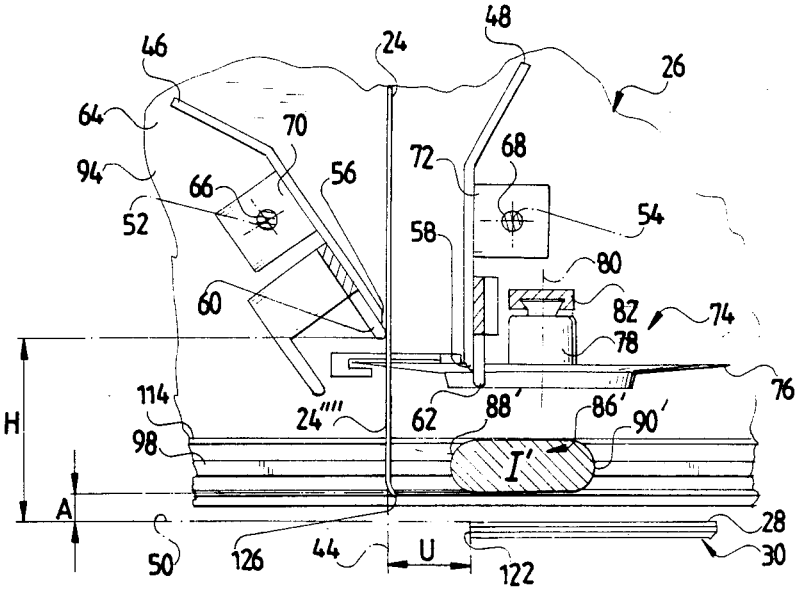
Figure 15:
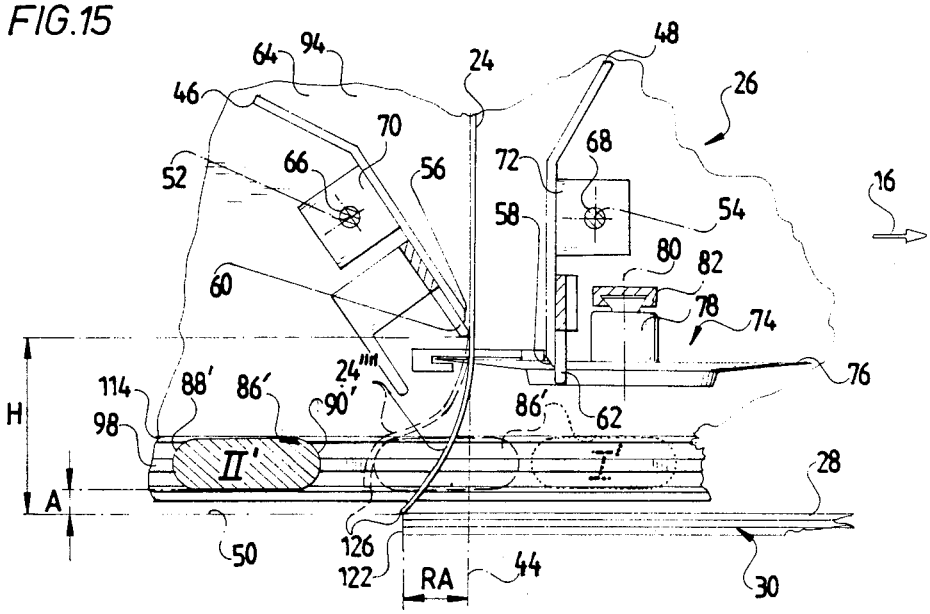
Figure 16:
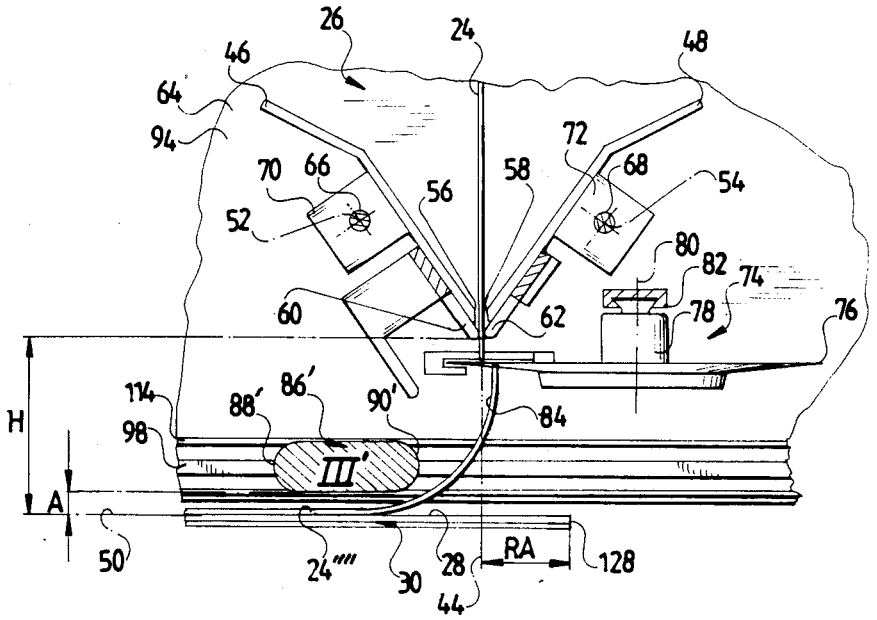

In the above-described work steps of the second embodiment according to FIGS. 11 to 13, the element 86' for directing the fabric web is always in its left laying-out position I', i.e., so far it did not have to be moved relative to the plane of fall 44. Also after the stopping of the laying carriage 12 after the overrun U beyond the left edge 122 of the pile of layers 30 and the restarting of the laying carriage to the right with simultaneous advance of the fabric web 24, the element 86' for directing the fabric web remains in its left laying-out position I', as illustrated in FIG. 14.

The element 86' for directing the fabric web is not moved until a sufficiently long piece 24'''' which almost reaches the layer plane 50 hangs down from the clamping jaw 60 of the swivel plate 46 standing in its closed position. In this position, illustrated in FIG. 15, the element 86' for directing the fabric web is displaced to the left so that it moves in the direction opposite to the laying direction onto the opposite side of the plane of fall. The fabric web piece 24'''' thereby slides onto the upper portion of the surface 88' for directing the fabric web and so this fabric web piece 24'''' is displaced in its entirety upwardly to the left, away from the layer plane 50. In this way, the front cut edge 126 is laid coincidentally with the left edge 122 of the pile of layers 30 in spite of the inherent curvature of the fabric web, thereby avoiding undesired rolling-up or unwanted formation of folds in this edge region.

To this end, the element 86' for directing the fabric web is moved very quickly into its extreme left position II' which is located at such a distance from the plane of fall 44 that the front cut edge 126 can slide down the upper portion of the surface 90' for directing the fabric web and come to rest at the left edge 122 of the pile of layers 30.

Figure 17:
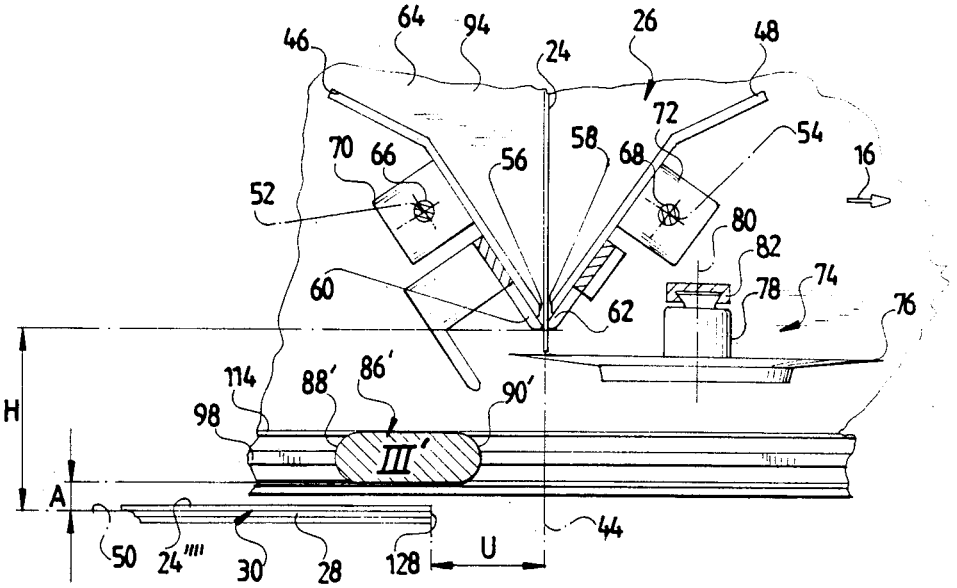

The element 86' for directing the fabric web is then driven into its right laying-out position III' in which it follows without any function the bend 84 as far as the right edge 128 and the fabric web 24 is likewise cut and spread out by the element 86' for directing the fabric web driving over it, as illustrated in FIG. 17. The subsequent changeover to laying-out to the left then takes place in analogy with the above description.

The present disclosure relates to the subject matter disclosed in German application No. P 38 16 882.0 of May 18, 1988, the entire specification of which is incorporated herein by reference.

What is claimed is:

1. Fabric laying machine for the zigzag laying of a fabric web comprising:

a means for guiding said fabric web having a means for delivery of said fabric web which is guided at a predetermined height above a pile of laid-out fabric layers and from which said fabric web falls freely during the laying and passes along a bend into the top fabric layer, a cutting-off means which is associated with said means for delivery of said fabric web, and a directing means having a surface for directing said fabric web, said surface deflecting said fabric web falling freely from said means for delivery of said fabric web and said surface being movable beneath said means for delivery of said fabric web for deflecting a freely falling end portion of said fabric web.

2. Fabric laying machine as defined in claim 1, characterized in that said surface for directing said fabric web deflects said freely falling end of said fabric web in the direction opposite to the laying direction.

3. Fabric laying machine as defined in claim 1, characterized in that said surface for directing said fabric web smooths out said freely falling cut end portion of the top fabric layer in the laying direction.

4. Fabric laying machine as defined in claim 2, characterized in that said surface for directing said fabric web is inclined in a direction opposite to the respective laying direction.

5. Fabric laying machine as defined in claim 1, characterized in that said surface for directing said fabric web extends transversely across a width of said fabric web.

6. Fabric laying machine as defined in claim 1, characterized in that said surface for directing said fabric web is movable in the laying direction and in the direction opposite thereto relative to said means for delivery of said fabric web.

7. Fabric laying machine as defined in claim 6, characterized in that said surface for directing said fabric web is movable below said means for delivery of said fabric web and between the latter and said pile of layers.

8. Fabric laying machine as defined in claim 6, characterized in that said surface for directing said fabric web is movable in a plane substantially parallel to the layer plane.

9. Fabric laying machine as defined in claim 6, characterized in that said surface for directing said fabric web is movable beyond said means for delivery of said fabric web.

10. Fabric laying machine as defined in claim 1, characterized in that two surfaces for directing said fabric web are provided for deflecting said freely falling fabric web in respectively opposed directions.

11. Fabric laying machine as defined in claim 10, characterized in that either the one or the other of said surfaces for directing said fabric web can be brought into its effective position beneath said means for delivery of said fabric web.

12. Fabric laying machine as defined in claim 10, characterized in that said surfaces for directing said fabric web are arranged on an element for directing said fabric web.

13. Fabric laying machine as defined in claim 12, characterized in that said element for directing said fabric web has surfaces for directing said fabric web which form a wedge-shaped surface facing said means for delivery of said fabric web with its tip.

14. Fabric laying machine as defined in claim 12, characterized in that said element for directing said fabric web has surfaces for directing said fabric web which with one portion deflect a freely falling end of said fabric web in the direction opposite to a laying direction and with a further portion smooth out a freely falling end of said top fabric layer during laying in the opposite laying direction.

15. Fabric laying machine as defined in claim 12, characterized in that said element for directing said fabric web is movable with each surface for directing said fabric web beyond said means for delivery of said fabric web.

16. Fabric laying machine as defined in claim 1, characterized in that said element for directing said fabric web is movable by a drive.

17. Fabric laying machine as defined in claim 15, characterized in that said element for directing said fabric web is displaceably held at its opposite ends on longitudinal guides.

18. Fabric laying machine as defined in claim 1, characterized in that said means for delivery of said fabric web comprises a device for clamping said fabric web.

19. Fabric laying machine as defined in claim 18, characterized in that said device for clamping said fabric web comprises two jaws which are movable towards each other.

20. Fabric laying machine as defined in claim 19, characterized in that said jaws are designed as side portions of an intake funnel.

21. Fabric laying machine as defined in claim 1, characterized in that a control means is provided for positioning said element for directing said fabric web ahead of a bend in said fabric web during the laying-out.

22. Fabric laying machine as defined in claim 1, characterized in that a control means is provided for positioning said element for directing said fabric web such that it supports said bend with a surface for directing said fabric web during the laying-out.

23. Fabric laying machine as defined in claim 1, characterized in that a control means is provided for positioning said element for directing said fabric web during the laying at the edge of said pile of layers and the restarting of said fabric laying machine such that it guides with a surface for directing said fabric web a front cut edge to said edge of said pile of layers.

24. Fabric laying machine as defined in claim 1, characterized in that a control means is provided for positioning said element for directing said fabric web such that it supports said fabric web during the cutting.

25. Fabric laying machine as defined in claim 1, characterized in that a control means is provided for moving said element for directing said fabric web such that it runs under said fabric web during the laying at said edge of said pile of layers.

26. Fabric laying machine as defined in claim 1, characterized in that a control means is provided for moving said element for directing said fabric web such that it spreads said cut-off fabric web out towards said edge of said pile of layers.

* * * * *